US005973652A

United States Patent [19]

Sanford et al.

[11] Patent Number: 5,973,652

[45] Date of Patent: Oct. 26, 1999

[54] REFLECTOR ANTENNA WITH IMPROVED RETURN LOSS

[75] Inventors: John R. Sanford, Palo Alto; William Comisky, Oakland, both of Calif.

[73] Assignee: Endgate Corporation, Sunnyvale, Calif.

[21] Appl. No.: 08/862,823

[22] Filed: May 22, 1997

[51] Int. Cl.[6] ..... H01Q 13/00

[52] U.S. Cl. ..... 343/781 P; 343/781 CA; 343/786; 343/840

[58] Field of Search ..... 343/781 P, 781 CA, 343/781 R, 775, 786, 840; 333/21 A, 21 R, 137

[56] References Cited

U.S. PATENT DOCUMENTS

| | | | |
|---|---|---|---|
| 2,605,416 | 7/1952 | Foster | 343/781 P |
| 3,747,116 | 7/1973 | Milam | 343/872 |
| 3,983,560 | 9/1976 | MacDougall | 343/781 CA |
| 4,626,863 | 12/1986 | Knop et al. | 343/781 P |
| 4,673,947 | 6/1987 | Newham | 343/781 CA |
| 4,827,277 | 5/1989 | Becker et al. | 343/781 P |
| 4,963,878 | 10/1990 | Kildal | 343/781 P |
| 4,982,198 | 1/1991 | Shafai et al. | 343/840 |
| 5,596,338 | 1/1997 | Smith | 343/786 |

FOREIGN PATENT DOCUMENTS

| | | | |
|---|---|---|---|
| 439800 | 8/1991 | European Pat. Off. | 343/781 P |

*Primary Examiner*—Don Wong
*Assistant Examiner*—Tan Ho
*Attorney, Agent, or Firm*—Cooley Godward; Anderson & Adamson

[57] ABSTRACT

An improved reflector antenna with far improved return loss than prior art subreflector antennas is disclosed herein. The invention uses a circular waveguide antenna feed employing a non-planar, subreflector having a radial cavity which reflects the energy from the waveguide onto a rotationally symmetrical main reflector. The dimensions of the feed tube, the subflector, and the connection between them are chosen to make the total reflection back into the feed tube very close to zero. The dimensions of the antenna feed are also chosen such that its radiation pattern has an amplitude null along the antenna feed axis. This further improves return loss by minimizing the amount of energy from the main reflector that gets directed back into the feed tube. An alternate embodiment features a feed radiation pattern with an asymmetric amplitude taper for improvement of the sidelobe envelope in a preferred plane.

9 Claims, 7 Drawing Sheets

REFLECTOR ANTENNA WITH IMPROVED RETURN LOSS

CROSS-REFERENCE TO RELATED APPLICATIONS

This invention is an improvement to that described in U.S. patent application Ser. No. 08/695,268 now U.S. Pat. No. 5,808,511.

INTRODUCTION

1. Technical Field

This invention relates to a reflector antenna with improved return loss. The invention uses an antenna feed comprising a circular waveguide feed tube connected to a non-planar subreflector having a radial cavity. The subreflector reflects the energy from the waveguide onto a rotationally symmetrical main reflector. The dimensions of the feed tube, the subreflector, and the connection between them are chosen to reduce or minimize the total reflection back into the feed tube. The dimensions of the subreflector are also chosen such that the antenna feed radiation pattern has an amplitude null along the antenna feed axis. This further improves return loss by minimizing the amount of energy from the main reflector that its directed back into the feed tube. An alternate embodiment features a feed radiation pattern with an asymmetric amplitude taper for improvement of the sidelobe envelope in a preferred plane.

2. Background

The antenna of the above cross referenced patent application is related to the present invention and uses a main reflector that subtends a large portion of the feed pattern (approximately 110 degrees). The feed pattern puts a large edge taper on the reflector (−20 db), which in turn gives very low antenna pattern sidelobes without the use of an absorbing cylinder around the main reflector. It also has a subreflector which is tapered rather than flat and has corrugations of varying depth to help guide the energy from the feed to the main reflector along a path which insures improved low sidelobes.

SUMMARY OF THE INVENTION

The quality of an antenna is judged by a number of factors, the most important being gain, sidelobe envelope, and return loss. Our goal is to improve the return loss over the invention of the related patent application, while maintaining a high gain and a low sidelobe envelope using a shroudless reflector. To do this we use a combination of a circular waveguide connected to a non-planar subreflector as an antenna feed. The subreflector has, as its primary reflecting surface in both the electric and magnetic field planes, a radial cavity which concentrates the energy from the waveguide onto the main reflector. The subreflector utilizes edge chokes to minimize spillover from the feed. The radial cavity sets up a standing wave which launches a nearly spherical wave, rotationally symmetric in phase, from the subreflector to the main reflector. The main reflector is shaped to form this wave into a plane wave which propagates to the farfield.

To design the antenna of this invention, we use an optimization procedure which involves iteratively solving Maxwell's equations for a number of varying feed geometries. In doing so, we solve for the feed dimensions which fit the solution constraints we define. The dimensions of the feed tube, the subreflector, and the connection, or plastic spacer, between them are constrained to be such that the energy reflected back down the feed tube is minimized. The radiation pattern of the feed is constrained to have an amplitude null in the direction of the feed axis, so that the contribution to the return loss due to energy from the main reflector re-entering the feed tube is reduced. The result is a dramatic improvement in return loss.

A second embodiment of the invention involves further constraining the feed pattern to have an asymmetric amplitude taper, while maintaining a symmetric phase distribution. Using this type of feed, an antenna can be constructed which has improved sidelobes in a preferred plane at the expense of the sidelobe levels in the orthogonal plane. This feature is attractive in those cases where only the sidelobes in a single plane are regulated for a given polarization.

A somewhat less effective embodiment for improving the return loss through the use of tuning screws is also described.

BRIEF DESCRIPTION OF THE DRAWING

The invention will be understood more fully with reference to the drawing wherein.

DESCRIPTION OF SPECIFIC EMBODIMENTS

Figure 1A:
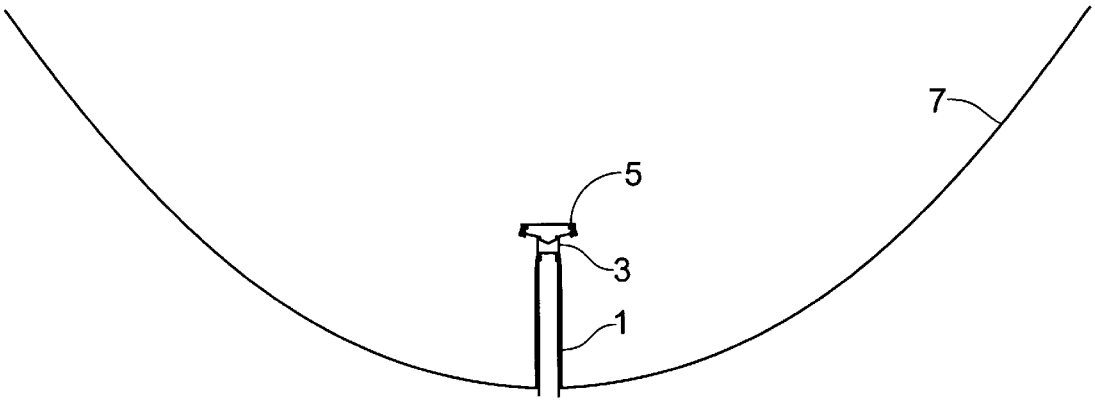
FIG. 1A illustrates a cross section of the generally preferred embodiment of the antenna of our invention.
Figure 1B:
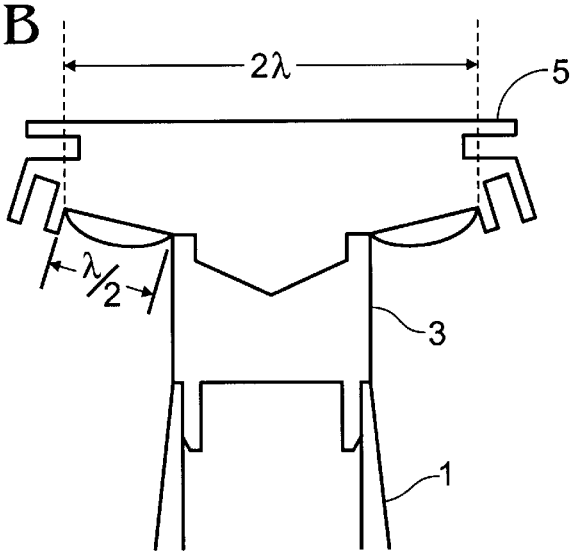
FIG. 1B illustrates the feed of FIG. 1A isolated from the main reflector to show the fine details.

A preferred embodiment of our invention is seen generally in FIG. 1A, with a close up of the feed cross section in FIG. 1B. The invention includes an antenna feed comprising a feed tube 1, a subreflector 5, and a connection therebetween comprising a plastic spacer 3. Also shown is a near-parabolic shaped main reflector 7. The figures of the drawing of this patent of this specification which illustrate the feed structure of various embodiments of our inventions show only the subreflector end of the feed. As we will show later, the total length of the feed tube, which is truncated in these figures, is dependent on the desired size of the main reflector. In the invention of related patent application Ser.

Figure 2:
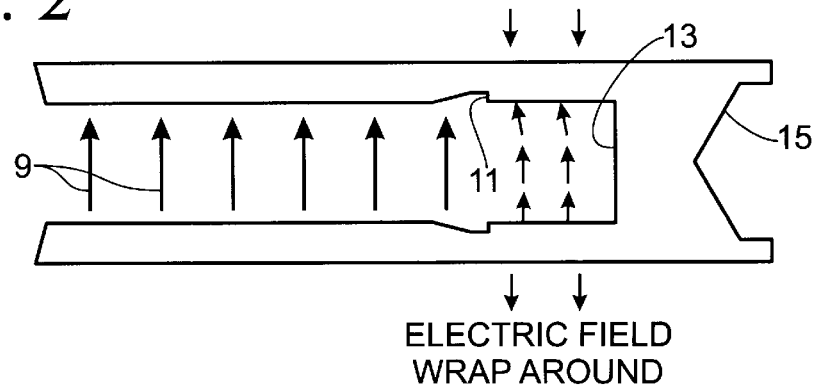
FIG. 2 illustrates the incident electric field on the subreflector of our invention.
Figure 4A:
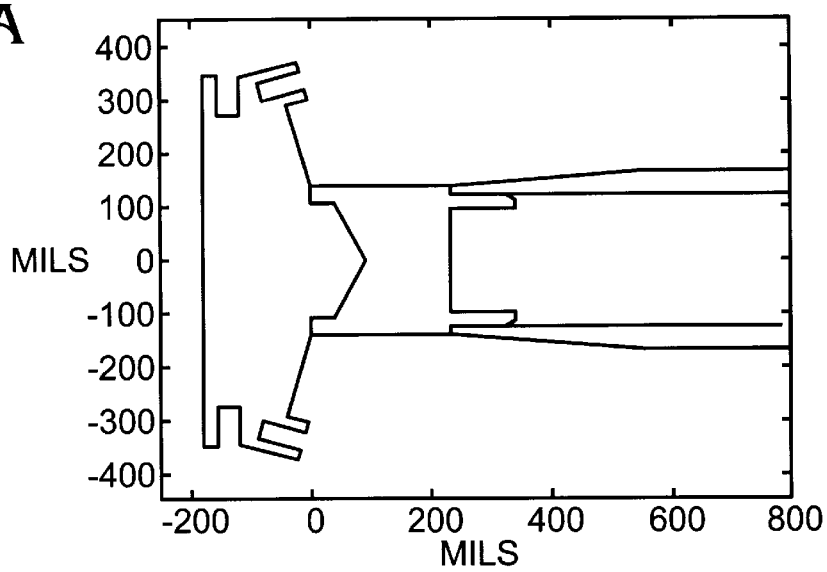
FIG. 4A illustrates the feed structure of the preferred embodiment of the feed tube-subreflector combination of our invention, with one illustrative set of dimensions therefor.
Figure 4B:
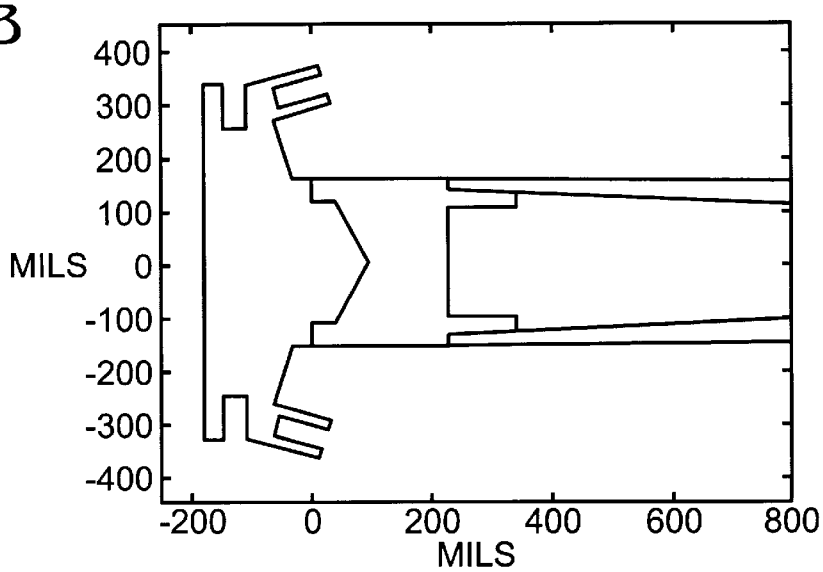
FIG. 4B illustrates the feed structure of an alternative embodiment of the feed tube-subreflector component of our invention, with one illustrative set of dimensions therefor.

No. 08/695,268, the feed tube wall tapers on the outside from its full thickness to a narrow edge in contact with the plastic spacer. The feed tube of the present invention can be of this form as seen in FIG. 1 and FIG. 4A, or of an alternate form where the tube has an inner radius which flares into a horn while the outer radius remains constant as seen in FIG. 2 and FIG. 4B. The plastic spacer 3 remains essentially the same as in the above application, except that it conforms to the new shape of the subreflector and the feed tube. The subreflector has changed dramatically from that of the related application. For the most part, it now does not use a corrugated surface. Instead it has edge chokes, that is, quarter wavelength deep corrugations, only at the edge or rim of the subreflector. It also has a radial cavity, formed between the plastic spacer and an edge corrugation, as its primary reflecting surface. The facing edges of the plastic spacer (and or associated center element of the subreflector) and the edge corrugation are also referred to as walls of the radial cavity. The radial cavity is approximately one half wavelength wide and about two wavelengths in diameter as shown in FIG. 1B. The subreflector is angled away from the feed horn. The main reflector is rotationally symmetric as in the above referenced patent application.

The electrical performance of the feed is tightly coupled to all three components, namely, the feed tube, the plastic spacer, and the subreflector. When we refer to the electrical performance, we mean the radiation pattern, and the return loss which is a measure of the energy reflected back into the feed tube. The radiation pattern of the feed is primarily defined by the shape of the subreflector and its spacing from the feed tube. The return loss is primarily defined by the subreflector's spacing from the feed tube and the shape of the feed features located close to the opening of the feed tube. As will be seen, dimensions for these features can be chosen to provide dramatic improvement in the return loss, without affecting the desired radiation pattern of the feed.

From a return loss perspective, the feed performs as follows: As seen in FIG. 2 for a feed with an internally flared feed tube, a TE11 mode energy wave 9 propagates down the feed tube and into the flare. It then encounters the plastic spacer 11 and a percentage of the wave is reflected back into the feed tube. The energy which is not reflected continues to propagate down the feed tube, where it next encounters the flat 13 on the plastic spacer and the end of the feed tube. These boundaries also cause partial reflections back into the feed tube. Finally, the wave hits the subreflector 15, and yet another portion of the wave is reflected into the feed tube. Each reflection is a vector quantity, that is, it has an amplitude and a phase. The remainder of the wave acts to induce a current on the subreflector primary reflecting surface 17 in FIG. 3, setting up a standing wave which in turn launches a wave through space to the main reflector. In our invention, only a small part of the plane wave formed by the main reflector is reflected back in the path of the subreflector. Some of this energy gets directed back into the feed tube as well. All of the above mentioned sources sum to determine the return loss.

Figure 3:
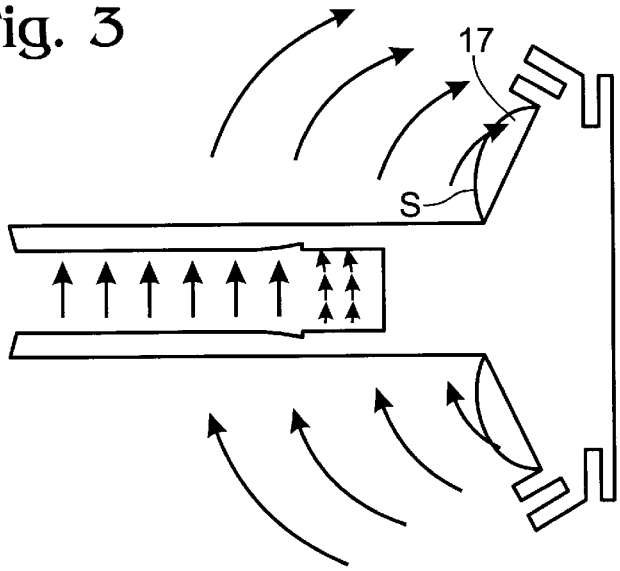
FIG. 3 illustrates the total electric field incident on the subreflector and reflected back to the main reflector of our invention.

The farfield radiation pattern of the antenna is determined by the amplitude and phase distribution of the energy which reaches the aperture, or front face, of the reflector. As seen in the FIG. 1B, the radial cavity on the subreflector will set up a standing wave S when illuminated with energy from the feed tube. As seen in FIG. 3, this standing wave launches a wave with the desired amplitude characteristics to the main reflector, which will then re-reflect the energy in equi-phase planes when the reflector surface is constructed with the appropriate profile. Generally, a parabolic reflector will form a plane wave when a spherical wave, with origin at the focus of the parabola, is incident on its surface. Our feed has a radiation pattern with a wave front that is not quite spherical. The main reflector 7 is a slight deviation from a parabola in order to match the shape of the feed pattern's phase front and shape it into a plane wave. The method of calculating the shape of the main reflector from the feed pattern is described below.

The characteristic parabola which we will perturb to form the main reflector of our invention is fixed given the desired values of the following: the diameter of the antenna, and the subtended angle from the feed to the rim of the reflector. To calculate the optimal main reflector shape, we first average the feed phase pattern in two orthogonal planes (see phase plots of FIG. 5 and FIG. 7). From this average phase pattern, we subtract the phase of a spherical wave with the same origin, which is constant as a function of angle. The result is the phase difference between our feed wave front and a spherical wave front at each angle from the feed axis out to the rim of the main reflector. We convert this phase difference into wavelengths, and therefore a distance given the operating frequency. Finally, we add this function in polar coordinates to that of the characteristic parabola for our reflector described above. Revolving this cross section about the feed axis generates the perturbed paraboloid surface of the main reflector of our invention. The illumination of this surface with radiation from its corresponding feed will produce plane waves at the aperture of the antenna.

An embodiment of the feed of our invention, therefore, can be used in any number of reflector antennas varying in diameter and depth, each with a characteristic parabola. The only change which must be made to the feed geometry is to extend the feed tube from the subreflector assembly, which is located at the main reflector focus, so that it will intersect with the reflector surface. Energy can then be launched down the circular waveguide of the feed tube from a source behind the reflector surface.

Spillover from the feed tube and diffraction around the subreflector also propagate to the farfield, and act to perturb the plane wave from the main reflector. As in the related patent application, these contributions are minimized by using a deep reflector which subtends a large portion of the feed pattern, and by utilizing corrugations and/or edge chokes on the rim to suppress the spillover and wrap-around currents. In contrast to the edge chokes of the related application, one of the edge choke corrugations is above the plane of the primary reflecting surface, which is surface 17 of FIG. 3.

The design of this invention relies heavily on an iterative optimization procedure. First we select a coarse set of feed dimensions which will give the desired feed pattern amplitude taper. The initial dimensions are varied, and Maxwell's equations are solved numerically for the new feed geometry over the desired frequency band. These solutions yield the electric current at every point on the surface of the feed, which in turn can be used to compute the electric field throughout space for our antenna. The return loss and radiation pattern characteristics of the feed are known when the fields are known. We optimize the feed design by iteratively varying the feed dimensions, so that the return loss and radiation pattern of the feed best meet the solution constraints we specify. The constraints for the feed of this invention are described below.

We first constrain the feed, independent of the main reflector, to have a minimal reflection back into the feed tube over the operational bandwidth of the antenna. The reflection from each boundary in the feed described previously is not necessarily minimized, rather the total vector sum is minimized. The reflections from all contributors effectively cancel. For now we ignore the contribution to the return loss of the main reflector, greatly simplifying the calculation and speeding up the optimization.

Figure 5:
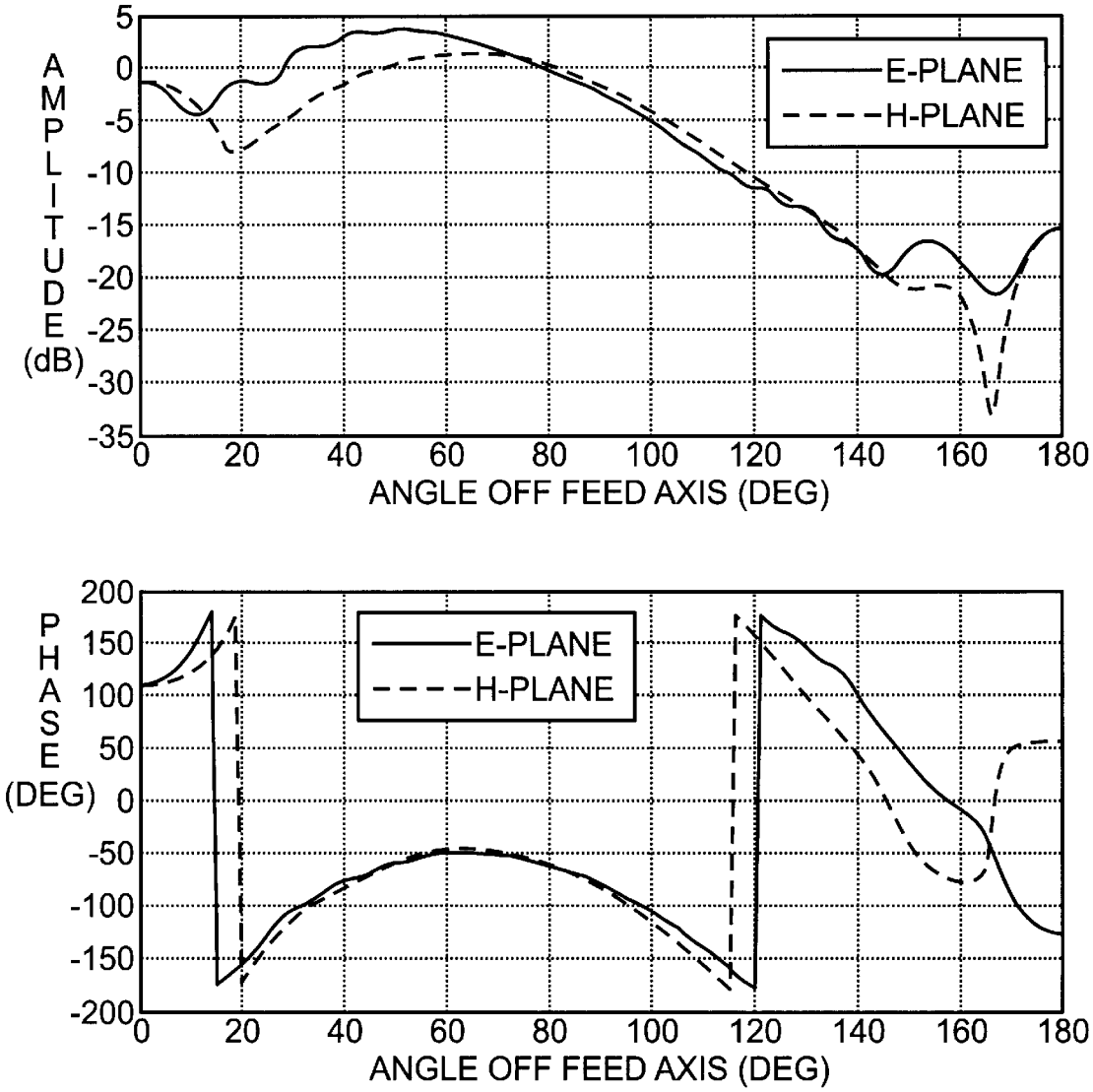
FIG. 5 illustrates the radiation pattern, in both amplitude and phase, of the feed illustrated in FIG. 4A.
Figure 7:
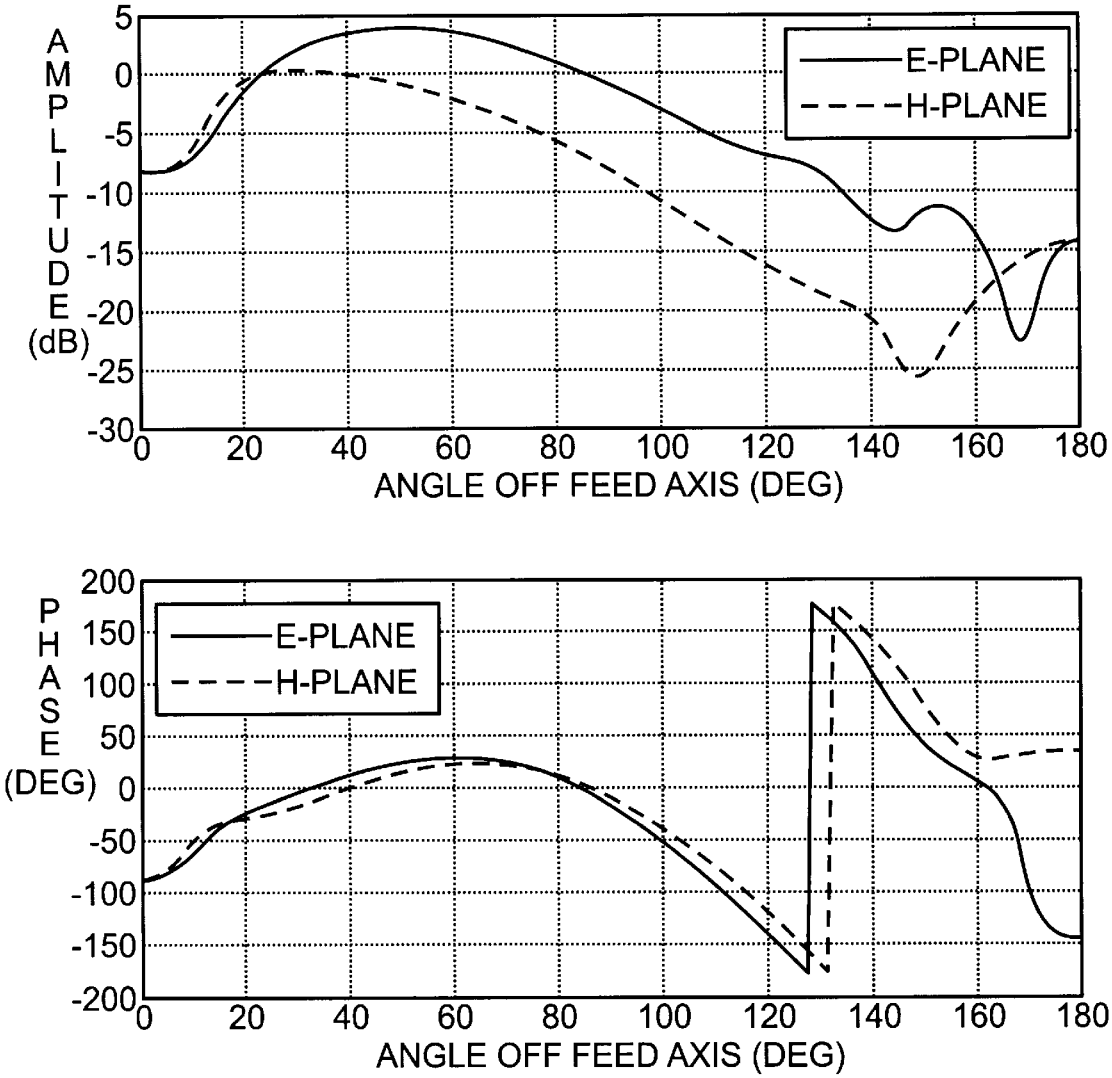
FIG. 7 illustrates the radiation pattern, in both amplitude and phase, of the feed illustrated in FIG. 4B.

The remainder of the constraints are imposed on the shape of the feed radiation pattern. As in the related patent application, we want a smooth feed pattern that provides a large amplitude edge taper for the main reflector. This will insure that we can achieve the desired farfield sidelobe levels without the use of an absorbing shroud. For ease of manufacture, we also want our antenna to have a rotationally symmetric reflector. Since the main reflector of this invention is shaped to fit the phase front of the feed pattern, we need to make our feed pattern phase as symmetric as possible to minimize the phase error. Thus the feed pattern phase of this invention has also been optimized as seen in FIG. 5 and FIG. 7 to be more symmetric than the invention of the related application out to larger angles. This helps to reduce phase error when using a deeper reflector which subtends a larger portion of the feed pattern, which in turn improves antenna directivity and sidelobe levels. In the optimization, we achieve this by minimizing the phase difference between the E-plane and the H-plane feed patterns. The success of this optimization can be seen in the phase diagrams of FIG. 5 and FIG. 7, where the E-plane and H-plane phases nearly over-lay each other for all subtended angles. This constraint also reduces the calculation of Maxwell's equations from three dimensions to two dimensions when modeling the antenna.

For this invention, we further stipulate that the feed pattern amplitude have a null in the direction of the rotational axis of the feed tube. The energy that hits the main reflector within a small angular radius of this axis gets reflected back directly into the path of the subreflector. Some of this energy gets directed back into the feed tube and contributes to the return loss. So by constraining the feed pattern to have an amplitude null in this region, we are minimizing the main reflector's contribution to the return loss.

Figure 8:
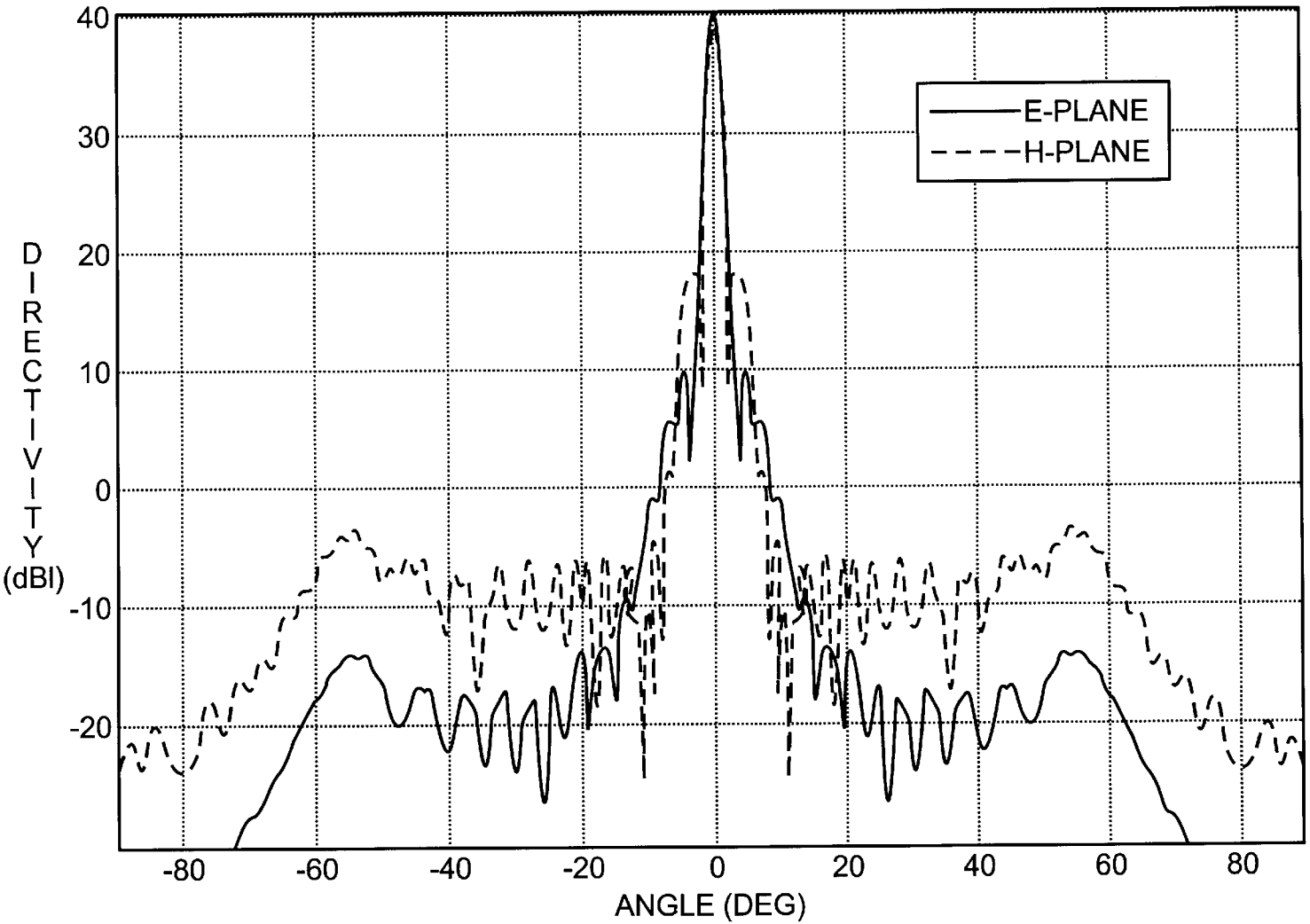
FIG. 8 illustrates the directivity, or far field pattern, of the antenna illustrated in FIG. 4B.
Figure 9:
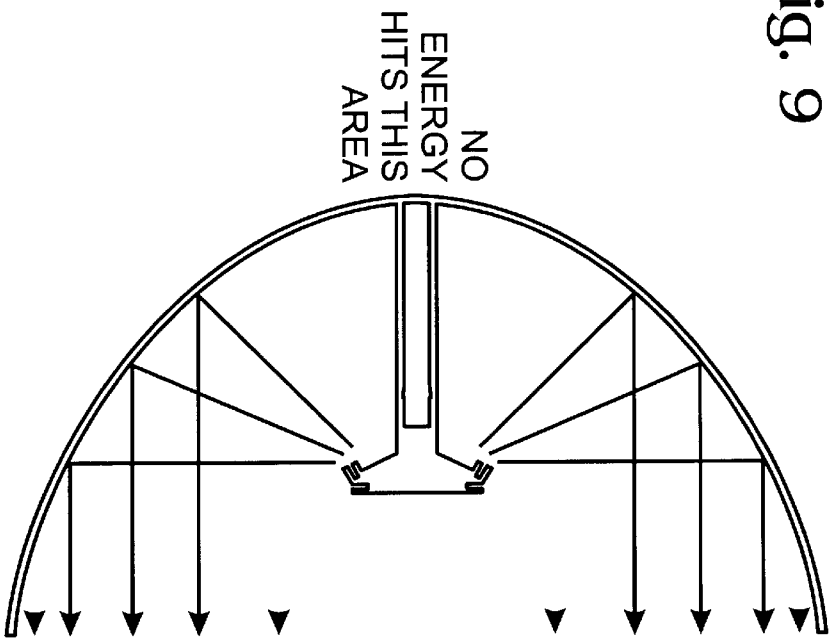
FIG. 9 illustrates the reflected energy from the main reflector missing the subreflector due to the feed pattern amplitude null along the axis of the feed.

In FIG. 2 we show a portion of the electric field propagating down the outside of the tube in the absence of the subreflector ("Electric field wrap around"). By optimizing the dimensions of the subreflector, namely the angle of its surface (17 of FIG. 3) and its diameter, the wave launched by the subreflector will have a field which is equal and opposite to the wrap-around electric field of FIG. 2. The two fields then cancel along the feed tube axis as depicted in FIG. 3. This effect is best seen in the feed pattern of FIG. 7. This is the feed radiation pattern for the embodiment of the invention shown in FIG. 4B, and it shows the amplitude and phase pattern in the plane of the magnetic field (H) and the electric field (E). The patterns have a relatively low magnitude (10 to 15 dB down from the peak amplitude) at zero degrees. This is dramatically different from most antenna feeds which have a maximum at zero degrees. The effect is magnified since the feed will also receive energy poorly from the main reflector in the direction of the feed axis, due to the antenna reciprocity relation. The effect of the feed pattern null on the antenna farfield pattern which is seen in FIG. 8 for this feed is insignificant, since it is confined in angle mainly to a region of the aperture where the subreflector acts as a blockage anyway. The end result is that the return loss of the feed and the reflector combined is approximately the same as that for the feed alone, a result which has been confirmed both by model and measurement. FIG. 9 illustrates the fact that the vast majority of the reflected energy from the main reflector misses the subreflector.

Communication between ground based antennas takes place in the azimuth plane, which is the H-plane for vertically polarized antennas. Because of this, most communication regulatory committees have specified low sidelobes for this polarization in the H-plane, but do not regulate sidelobes in the E-plane. Therefore, it would be an attractive feature if we could trade off between the two planes, sacrificing the sidelobe levels in the E-plane for improved sidelobe levels in the H-plane. We accomplish this trade off in a second embodiment of the invention which is seen generally in FIG. 4B, including one specific set of dimensions for the feed.

Figure 6:
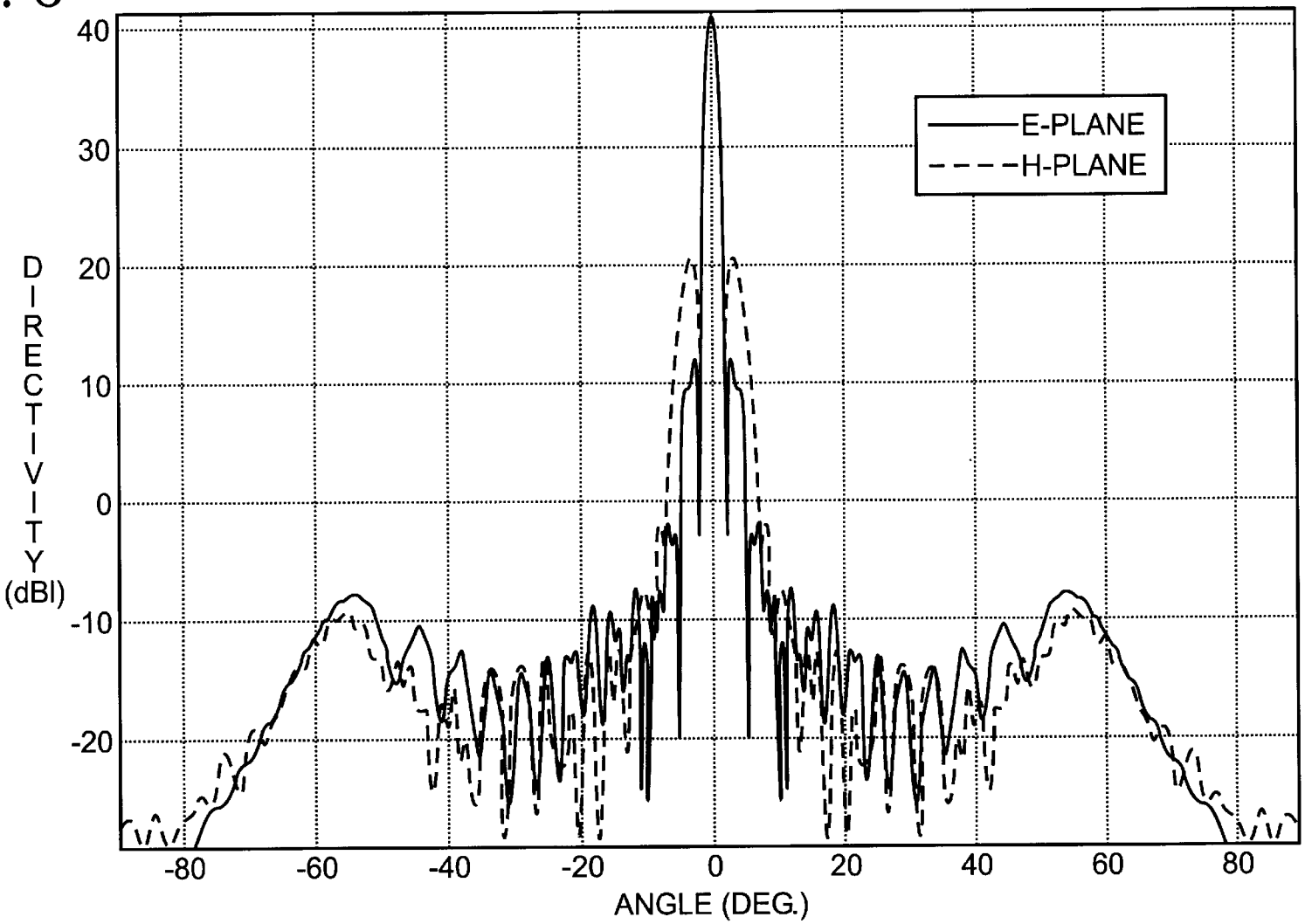
FIG. 6 illustrates the directivity, or farfield pattern, of the antenna using the embodiment illustrated in FIG. 4A.

For this embodiment, we further constrain the feed pattern as seen in FIG. 7 to have an asymmetric amplitude distribution as contrasted to the essentially symmetric feed pattern amplitude of FIG. 5. By making the feed pattern amplitude asymmetric, we effectively redistribute the energy across the antenna aperture. A feed pattern of the type shown in FIG. 7 has the effect of putting more energy into the E-plane of the antenna, making the amplitude distribution more uniform across that plane. In the H-plane, the taper in amplitude from the maximum value to the value on the edge of the aperture is increased. In the farfield, this has the effect of raising the E-plane sidelobes while lowering those in the H-plane, since sidelobes decrease with an increase in the amplitude taper. The total amount of energy incident on the reflector surface remains roughly the same, allowing us to maintain the same gain as a similar antenna with a symmetric amplitude distribution. The farfield pattern of a one foot diameter reflector with a feed of the second embodiment of FIG. 4B is shown in FIG. 8. FIG. 6 shows a farfield pattern of an antenna of equivalent size but with a feed of the embodiment shown in FIG. 4A, and symmetric feed radiation pattern shown in FIG. 5. We see that while the gains of the two antennas are similar, the sidelobe levels in FIG. 8 show a pronounced difference in the sidelobe levels between the two planes, while FIG. 6 does not. It should be noted that the same procedure can be used to improve the E-plane sidelobes for a horizontally polarized antenna.

Figure 10:
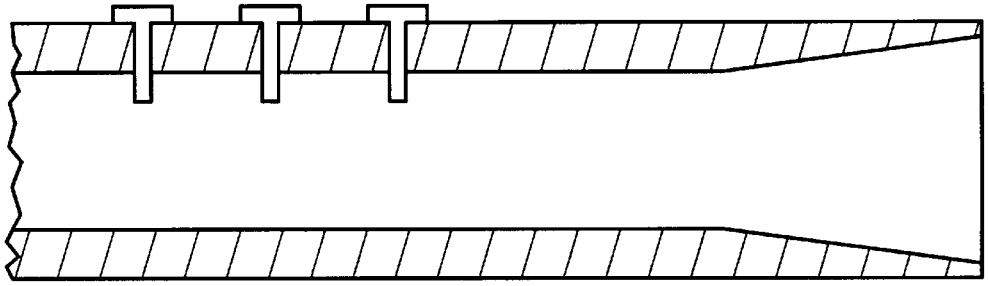
FIG. 10 illustrates a third embodiment of our invention, employing tuning screws.

A third embodiment of the invention involves an alternate method of achieving an improvement in return loss. For this embodiment, we solve Maxwell's equations for the desired pattern characteristics only, and do not constrain the return loss of our feed in the optimization. A reasonable return loss improvement can be achieved by using tuning screws in the feed tube of the resultant feed design, as seen in FIG. 10. The location and insertion depth of these screws would have to be determined experimentally for a given feed design, these parameters being tuned until the return loss is minimized. In this manner feed geometries with reasonably constant reflections as a function of frequency can be matched over a broad bandwidth. Using tuning screws can yield improved return loss over the prior art, though the results will not be as good as those realized with the preferred embodiment of the invention.

All publications and patent applications mentioned in this specification are herein incorporated by reference to the same extent as if each individual publication or patent application was specifically and individually indicated to be incorporated by reference.

The invention now being fully described, it will be apparent to one of ordinary skill in the art that many changes and modifications can be made thereto without departing from the spirit or scope of the appended claims.

What is claimed is:

1. An antenna comprising in combination:

a main reflector;

an antenna feed physically maintained by a connection to said main reflector, said feed comprising a waveguide feed tube having an end, a subreflector and a connection between said tube and said subreflector, said feed tube for illuminating directly said subreflector with an energy wave; and a generally conically shaped subreflector for reflecting an energy wave from said waveguide to said main reflector, said subreflector extending beyond the end of said waveguide and having a radial cavity as its primary reflecting surface, said radial cavity being approximately one half wave length in width and having radially spaced-apart, circumferentially extending inner and outer walls and a recessed surface between said walls, said surface having a length between said walls that is greater than the height of said walls, said cavity setting up a standing wave for launching an energy wave to said main reflector.

2. The antenna of claim 1 in which the subreflector has at least one corrugation, said at least one corrugation being located only at the edge of said subreflector, for preventing or reducing energy spillover from said radial cavity.

3. The antenna of claim 2 in which the top surface of one of said at least one corrugation is above the surface of said radial cavity.

4. A symmetrically peaked antenna subreflector having a radial cavity including radially spaced-apart, circumferentially extending inner and outer walls and a recessed surface extending between said walls, said surface having a length between said walls that is greater than the height of said walls, and at least one corrugation, said at least one corrugation being located only at the outer edge of said radial cavity.

5. The subreflector of claim 4 wherein said radial cavity is approximately a half wavelength in width and approximately two wavelengths in diameter.

6. The subreflector of claim 4 in which said corrugation extends above the surface of said radial cavity.

7. An antenna subreflector comprising a circular reflecting element having a primary reflecting surface symmetrically non-planar about a central axis and at least one corrugation, said at least one corrugation located only at the outer edge of said primary reflecting element with the top of said corrugation extending above the primary reflecting surface of said reflecting element a distance less than the radial length of the primary reflecting surface.

8. A method of using the shape of a non-planar subreflector with at least one corrugation, said at least one corrugation located only at the edge of the subreflector, to guide energy in a desired direction comprising the steps of:

selecting an axially symmetrical main reflector having a focus;

affixing a waveguide feed tube to said main reflector;

affixing to an end of said waveguide feed tube, at said focus, a symmetrically peaked subreflector extending beyond the end of the feed tube and having a radial cavity having radially spaced-apart, circumferentially extending inner and outer walls and a recessed surface extending between said walls, said surface having a length between said walls that is greater than the height of said walls, and at least one corrugation located only at the outer edge of said radial cavity; and illuminating said subreflector with an electromagnetic wave from said waveguide feed tube.

9. A method of illuminating with an energy wave a non-planar subreflector having a radial cavity with radially spaced-apart, circumferentially extending inner and outer walls and a recessed surface extending between said walls, said surface having a length between said walls that is greater than the height of said walls, and at least one corrugation located only at the outer edge of said radial cavity.

* * * * *